US006852016B2

(12) United States Patent
Henderson

(10) Patent No.: US 6,852,016 B2
(45) Date of Patent: Feb. 8, 2005

(54) END EFFECTORS AND METHODS FOR MANUFACTURING END EFFECTORS WITH CONTACT ELEMENTS TO CONDITION POLISHING PADS USED IN POLISHING MICRO-DEVICE WORKPIECES

(75) Inventor: Gary O. Henderson, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 130 days.

(21) Appl. No.: 10/246,944

(22) Filed: Sep. 18, 2002

(65) Prior Publication Data

US 2004/0053567 A1 Mar. 18, 2004

(51) Int. Cl.[7] ..... B24B 1/00
(52) U.S. Cl. ..... 451/56; 451/443
(58) Field of Search ..... 451/56, 444, 443

(56) References Cited

U.S. PATENT DOCUMENTS

| | | | | |
|---|---|---|---|---|
| 5,616,069 | A | 4/1997 | Walker et al. | |
| 5,645,682 | A | 7/1997 | Skrovan | |
| 5,655,951 | A | 8/1997 | Meikle et al. | |
| 5,725,417 | A | 3/1998 | Robinson | |
| 5,779,522 | A | 7/1998 | Walker et al. | |
| 5,782,675 | A | 7/1998 | Southwick | |
| 5,801,066 | A | 9/1998 | Meikle | |
| 5,833,519 | A | 11/1998 | Moore | |
| 5,846,336 | A | 12/1998 | Skrovan | |
| 5,879,226 | A | 3/1999 | Robinson | |
| 5,910,043 | A | 6/1999 | Manzonie et al. | |
| 5,975,994 | A | 11/1999 | Sandhu et al. | |
| 6,004,196 | A | 12/1999 | Doan et al. | |
| 6,083,085 | A | 7/2000 | Lankford | |
| 6,196,899 | B1 | 3/2001 | Chopra et al. | |
| 6,203,413 | B1 | 3/2001 | Skrovan | |
| 6,220,934 | B1 | 4/2001 | Sharples et al. | |
| 6,238,270 | B1 | 5/2001 | Robinson | |
| 6,273,800 | B1 | 8/2001 | Walker et al. | |
| 6,284,660 | B1 | 9/2001 | Doan | |
| 6,306,008 | B1 | 10/2001 | Moore | |
| 6,331,139 | B2 | 12/2001 | Walker et al. | |
| 6,350,691 | B1 | 2/2002 | Lankford | |
| 6,352,470 | B2 | 3/2002 | Elledge | |
| 6,354,923 | B1 | 3/2002 | Lankford | |
| 6,361,411 | B1 | 3/2002 | Chopra et al. | |
| 6,361,413 | B1 | 3/2002 | Skrovan | |
| 6,368,197 | B2 | 4/2002 | Elledge | |
| 6,439,986 | B1 | 8/2002 | Myoung et al. | |
| 6,500,054 | B1 * | 12/2002 | Ma et al. | 451/56 |
| 6,672,945 | B1 * | 1/2004 | Matsuo et al. | 451/56 |

* cited by examiner

*Primary Examiner*—Eileen P. Morgan
(74) *Attorney, Agent, or Firm*—Perkins Coie LLP

(57) ABSTRACT

End effectors, apparatuses including end effectors for conditioning planarizing pads, and methods for manufacturing end effectors with contact elements to condition planarizing pads used in polishing micro-device workpieces are disclosed herein. In one embodiment, an end effector includes a member having a first surface and a plurality of generally uniformly shaped contact elements attached to the first surface. The uniformly shaped contact elements project generally transversely from the first surface. In a further aspect of this embodiment, the uniformly shaped contact elements can be conical, frusto-conical, cylindrical, or other suitable configurations. The contact elements can also have a wear-resistant, carbon-like-diamond, silicon, and/or silicon carbide layer. Furthermore, the contact elements can have generally rounded tips.

36 Claims, 4 Drawing Sheets

END EFFECTORS AND METHODS FOR MANUFACTURING END EFFECTORS WITH CONTACT ELEMENTS TO CONDITION POLISHING PADS USED IN POLISHING MICRO-DEVICE WORKPIECES

TECHNICAL FIELD

The present invention relates to end effectors, apparatuses including end effectors for conditioning polishing pads, and methods for manufacturing end effectors with contact elements to condition polishing pads used in polishing micro-device workpieces.

BACKGROUND

Mechanical and chemical-mechanical planarization processes (collectively "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpiece 12 may be attached, or the workpiece 12 may be attached to a resilient pad 34 under the lower surface 32. The carrier head 30 may be a weighted, free-floating wafer carrier, or an actuator assembly 36 may be attached to the carrier head 30 to impart rotational motion to the micro-device workpiece 12 (indicated by arrow J) and/or reciprocate the workpiece 12 back and forth (indicated by arrow I).

The planarizing pad 40 and a planarizing solution 44 define a planarizing medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads.

To planarize the micro-device workpiece 12 with the CMP machine 10, the carrier head 30 presses the workpiece 12 face-down against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the workpiece 12 against the planarizing surface 42. As the micro-device workpiece 12 rubs against the planarizing surface 42, the planarizing medium removes material from the face of the workpiece 12.

The CMP process must consistently and accurately produce a uniformly planar surface on the micro-device workpiece 12 to enable precise fabrication of circuits and photo-patterns. One problem with conventional CMP methods is that the planarizing surface 42 of the planarizing pad 40 can wear unevenly or become glazed with accumulations of planarizing solution 44 and/or material removed from the micro-device workpiece 12 and/or planarizing pad 40. To restore the planarizing characteristics of the planarizing pad 40, the pad 40 is typically conditioned by removing the accumulations of waste matter with a conditioner 50. The conventional conditioner 50 includes an abrasive end effector 51 generally embedded with diamond particles and a separate actuator 55 coupled to the end effector 51 to move it rotationally, laterally, and/or axially, as indicated by arrows A, B, and C, respectively. The typical end effector 51 removes a thin layer of the planarizing pad material in addition to the waste matter to form a new, clean planarizing surface 42 on the planarizing pad 40.

One drawback of conventional end effectors and conventional methods for conditioning planarizing pads is that the embedded diamond particles can break or fall off the end effector during conditioning. The diamond particles often become loose as the material bonding the particles to the end effector wears away. Loose diamond particles can become trapped in grooves in the planarizing pad and cause defects in a micro-device workpiece during planarizing. Furthermore, the sharp edges of the diamond particles aggressively abrade and cut the planarizing pad during conditioning, consequently reducing the life of the pad.

SUMMARY

The present invention is directed to end effectors, apparatuses including end effectors for conditioning planarizing pads, and methods for manufacturing end effectors with contact elements to condition planarizing pads used in polishing micro-device workpieces. In one embodiment, an end effector includes a member having a first surface and a plurality of generally uniformly shaped contact elements attached to the first surface. The uniformly shaped contact elements project generally transversely from the first surface. In a further aspect of this embodiment, the uniformly shaped contact elements can be conical, frusto-conical, cylindrical, or other suitable configurations. The contact elements can also have a wear-resistant layer, such as a carbon-like-diamond or silicon carbide layer. Furthermore, the contact elements can have generally rounded tips.

In another embodiment of the invention, the end effector includes a plate having a first surface, a first plurality of contact elements, and a second plurality of contact elements. The first plurality of contact elements are arranged in a first pattern in a first region of the first surface, and the second plurality of contact elements are arranged in a second pattern in a second region of the first surface. The first pattern can be generally the same as the second pattern. In a further aspect of this embodiment, the first and second patterns can include rows of contact elements arranged in a grid or staggered rows. In another aspect of this embodiment, one contact element can be spaced apart from an adjacent contact element. In a further aspect of this embodiment, the first plurality of contact elements can include a first contact element having a first height and a second contact element having a second height different than the first height.

In another embodiment of the invention, a method for forming contact elements on the end effector includes forming a base layer on a first surface of the end effector and removing portions of the base layer to form bases. The bases project from the first surface. In a further aspect of this embodiment, removing portions of the base layer includes etching the base layer to form bases that are generally conical, frusto-conical, cylindrical, or other suitable configurations. In a further aspect of this embodiment, the method further includes placing a wear-resistant layer on the base layer. The wear resistant layer can be a carbon-like-diamond or silicon carbide layer.

In a further embodiment of the invention, a method for manufacturing an end effector includes forming bases in or on the end effector and depositing a wear-resistant layer onto the bases form contact elements. In a further aspect of this embodiment, forming bases on the end effector includes etching a plate of the end effector.

DETAILED DESCRIPTION

The present invention is directed to end effectors, apparatuses including end effectors for conditioning planarizing pads, and methods for manufacturing end effectors with contact elements to condition planarizing pads used for polishing micro-device workpieces. The term "micro-device workpiece" is used throughout to include substrates in and/or on which microelectronic devices, micro-mechanical devices, data storage elements, and other features are fabricated. For example, micro-device workpieces can be semiconductor wafers, glass substrates, insulated substrates, or many other types of substrates. Furthermore, the terms "planarizing" and "planarization" mean either forming a planar surface and/or forming a smooth surface (e.g., "polishing"). Several specific details of the invention are set forth in the following description and in FIGS. 2A–5B to provide a thorough understanding of certain embodiments of the invention. One skilled in the art, however, will understand that the present invention may have additional embodiments, or that other embodiments of the invention may be practiced without several of the specific features explained in the following description.

Figure 1:
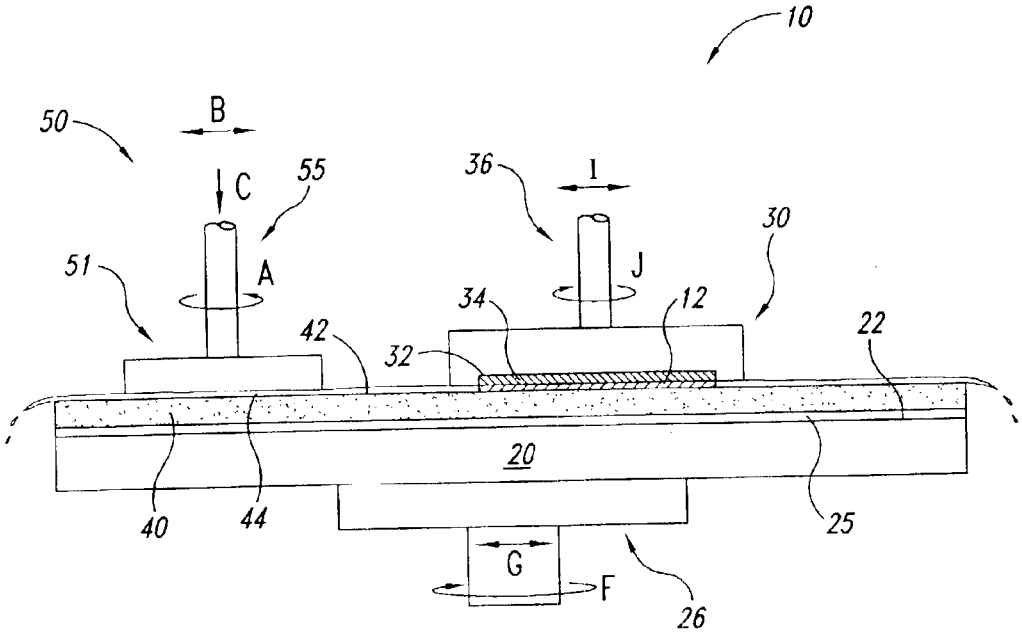
Fig. 1 (Prior Art)
FIG. 1 is a schematic cross-sectional view of a portion of a rotary planarizing machine and an abrasive end effector in accordance with the prior art.
Figure 2A:
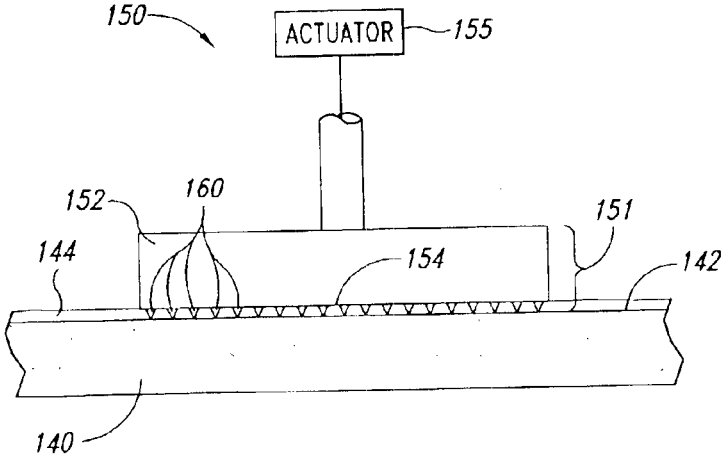
FIG. 2A is a schematic cross-sectional view of a conditioner in accordance with one embodiment of the invention.

FIG. 2A is a schematic cross-sectional view of a conditioner 150 in accordance with one embodiment of the invention. The conditioner 150 can be coupled to a CMP machine having a planarizing pad 140, such as the CMP machine 10 discussed above with reference to FIG. 1. The conditioner 150 can include an end effector 151 and an actuator 155 (shown schematically) coupled to the end effector 151 to move it relative to the planarizing pad 140. The end effector 151 refurbishes the planarizing pad 140 to bring a planarizing surface 142 on the pad 140 to a desired state for consistent planarizing.

In the illustrated embodiment, the end effector 151 includes a plate 152 and a plurality of contact elements 160 projecting from the plate 152. The plate 152 can be a circular member having at least one generally flat surface, such as a first surface 154. In one embodiment, the plate 152 is made of a non-corrosive material, such as stainless steel, to resist the corrosive effects of a planarizing solution 144. In additional embodiments, other materials including other non-corrosive materials can be used.

Figure 2B:
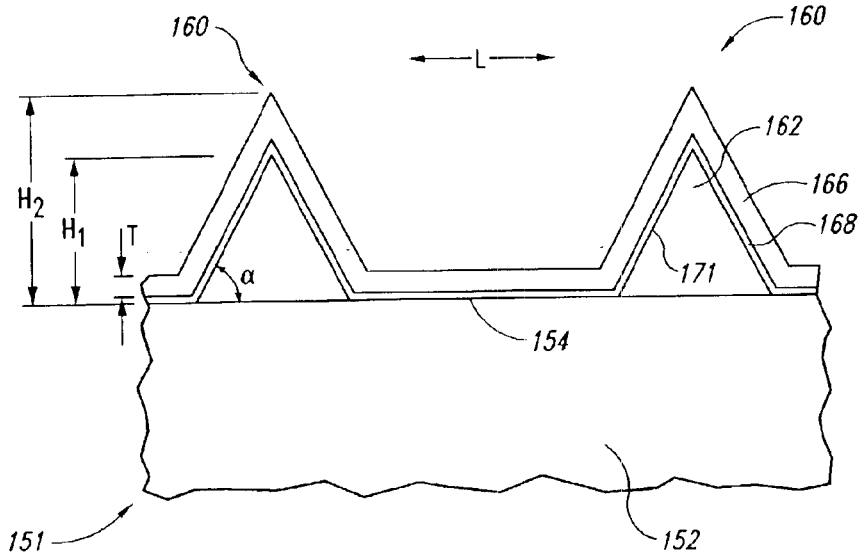
FIG. 2B is a cross-sectional view of a portion of the conditioner of FIG. 2A.

FIG. 2B is a cross-sectional view of a portion of the end effector 151 of FIG. 2A. The contact elements 160 of the end effector 151 are coupled to and project generally transversely from the first surface 154 of the plate 152. The contact elements 160 can be protrusions that include a base 162, a wear-resistant layer 166, and an adhesive 168 between the base 162 and the wear-resistant layer 166. In the illustrated embodiment, the bases 162 are generally conical. In additional embodiments, such as those described below with reference to FIGS. 4A–4D, the bases 162 can have other shapes. The conical shape is defined by a first surface 171 that intersects the first surface 154 of the plate 152 at an angle $\alpha$. In one embodiment, the angle $\alpha$ can be from about 45 degrees to about 60 degrees. In other embodiments, the angle $\alpha$ can be less than 45 degrees or greater than 60 degrees. In any of the foregoing embodiments, the bases 162 can include metal, glass, carbon, silicon, such as polysilicon, or other materials.

The wear-resistant layer 166 can be attached to the bases 162 with the adhesive 168. In other embodiments, the contact elements 160 do not include an adhesive 168, and the wear-resistant layer 166 is attached directly to the bases 162. The wear-resistant layer 166 provides a durable wear-resistant film to withstand the conditioning cycles. In one embodiment, the wear-resistant layer 166 can include carbon-like-diamond ("CLD") or silicon carbide. In other embodiments, other wear-resistant materials with various hardnesses can be used. For example, a hard wear-resistant material can be used with a hard planarizing pad and a soft wear-resistant material can be used with a soft planarizing pad. In additional embodiments, the contact elements 160 may not include the wear-resistant layer 166.

The contact elements 160 can be formed on or in the plate 152 using various processes. For example, in one embodiment, the bases 162 are formed by depositing a layer of base material across the first surface 154 of the plate 152 with a thickness $H_1$. The layer of material for the bases 162 can be deposited by chemical vapor deposition ("CVD"), plasma vapor deposition ("PVD"), or other methods. Depending on the material of the bases 162 and the plate 152, an adhesive may be required to adhere the bases 162 to the first surface 154.

After depositing the material for the bases 162 across the plate 152, portions of the base material are removed to create the bases 162. For example, to create the contact elements 160 of FIGS. 2A and 2B, portions of the base layer are removed to form the conical shaped bases 162. In one embodiment, the excess base material can be removed by etching. For example, an isotropic etch can be used to create the conical shaped bases 162. In additional embodiments, the bases 162 can be an integral part of the plate 152, formed from the material of the plate 152. In these embodiments, portions of the plate 152 are removed to create the bases 162.

After forming the bases 162, the adhesive 168 can be deposited across the bases 162 and the first surface 154 of the plate 152. As discussed above, in other embodiments, the adhesive 168 may not be used. Next, the wear-resistant layer 166 is deposited on the adhesive 168. The wear-resistant layer 166 can be deposited by CVD, PVD, or other methods. The wear-resistant layer 166 can have a thickness T of from about 1 micron to about 2 microns. In other embodiments, the wear-resistant layer 166 can have a thickness T of less than 1 micron or greater than 2 microns. Including the wear-resistant layer 166, the contact elements 160 can have a height $H_2$ of from about 0.002 inch to about 0.003 inch. In other embodiments, the contact elements 160 can have a height $H_2$ of less than 0.002 inch or greater than 0.003 inch.

Referring to FIGS. 2A and 2B, once the contact elements 160 have been formed on the plate 152, the conditioner 150 can condition the planarizing pad 140 to bring the planarizing surface 142 of the pad 140 to a desired state for consistent planarizing. In conditioning, the contact elements 160 move in a direction L relative to the planarizing pad 140 to engage and abrade the pad 140. The contact elements 160 remove accumulations of glaze and other waste matter from the planarizing pad 140, and they can create microgrooves in the pad 140 to assist in the transport of planarizing solution 144 across the pad 140.

One advantage of the illustrated embodiment is that the uniform shape of the contact elements 160 and the uniform distribution of the contact elements 160 increases the predictability of the conditioning process. For example, the end effector 151 has a predictable life expectancy and creates a uniform and predictable surface on the planarizing pad. Conventional end effectors, in contrast, typically include diamond particles with numerous shapes and sizes that are distributed and oriented randomly across the surface of the end effector. Conventional end effectors accordingly create unpredictability in the conditioning process. Another advantage of the illustrated embodiment is that the contact elements 160 are not expected to break off and become trapped in the grooves of the planarizing pad 140.

Figure 3:
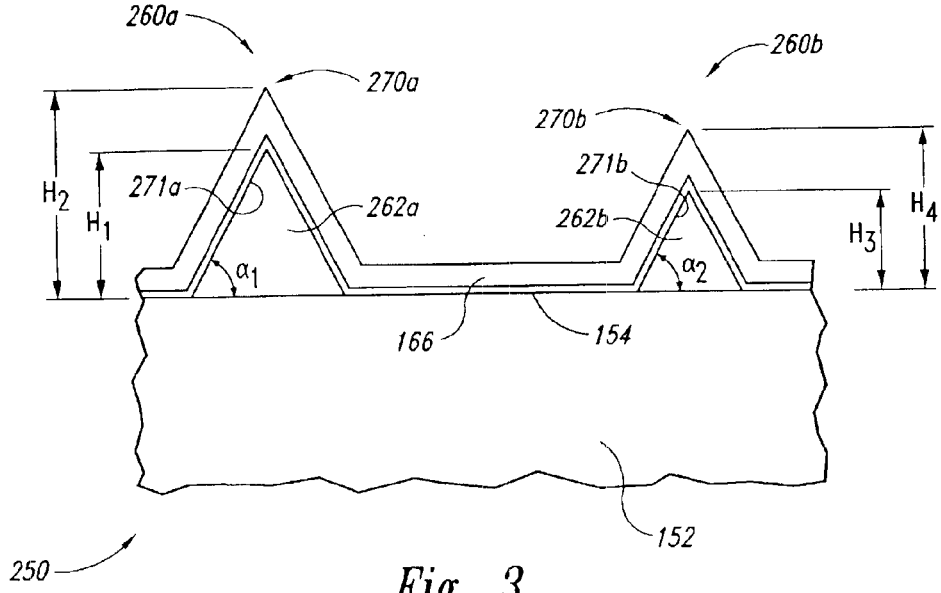
FIG. 3 is a cross-sectional view of a portion of an end effector having a plurality of contact elements with different heights in accordance with another embodiment of the invention.

FIG. 3 is a cross-sectional view of a portion of an end effector 250 having a plurality of contact elements 260 with different heights in accordance with another embodiment of the invention. The end effector 250 of the illustrated embodiment includes a first contact element 260*a* having a first height $H_2$ and a second contact element 260*b* having a second height $H_4$ less than the first height $H_2$. Other contact elements (not shown) on the end effector 250 can have other heights greater than or less than the first and second heights $H_2$ and $H_4$. The first contact element 260*a* includes a base 262*a* having a third height $H_1$ and a first surface 271*a* that intersects the first surface 154 of the plate 152 at a first angle $\alpha_1$. The second contact element 260*b* includes a base 262*b* having a fourth height $H_3$ and a first surface 271*b* that intersects the first surface 154 the plate 152 at a second angle $\alpha_2$. In one embodiment, the first angle $\alpha_1$, can be at least approximately equal to the second angle $\alpha_2$. In other embodiments, the first angle $\alpha_1$, can be greater than or less than the second angle $\alpha_2$. One advantage of the contact elements 260 of the illustrated embodiment is that as one contact element 260 wears, another new, sharp contact element 260 that has not previously engaged the planarizing pad because of its shorter height is able to condition the pad.

Figure 4A:
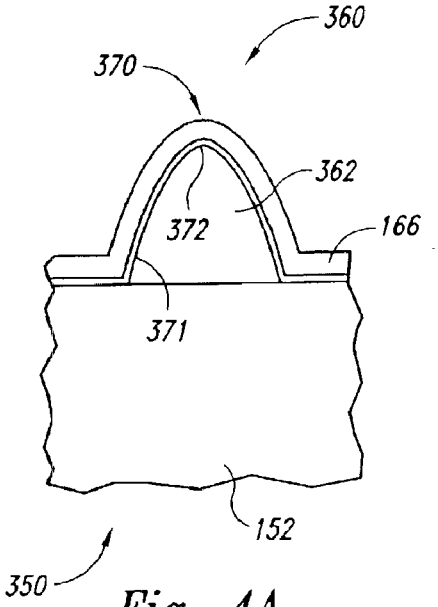
FIG. 4A is a cross-sectional view of a portion of an end effector having a contact element in accordance with another embodiment of the invention.

FIG. 4A is a cross-sectional view of a portion of an end effector 350 having a contact element 360 in accordance with another embodiment of the invention. The contact element 360 has a rounded tip 370 and includes a base 362 attached to the plate 152. The base 362 has a first surface 371 and a rounded top surface 372 that intersects the first surface 371 proximate to the distal end of the base 362. One advantage of the illustrated embodiment is that the rounded tip 370 is not quite as aggressive in abrading the planarizing pad during conditioning. Consequently, the life of the planarizing pad is extended.

Figure 4B:
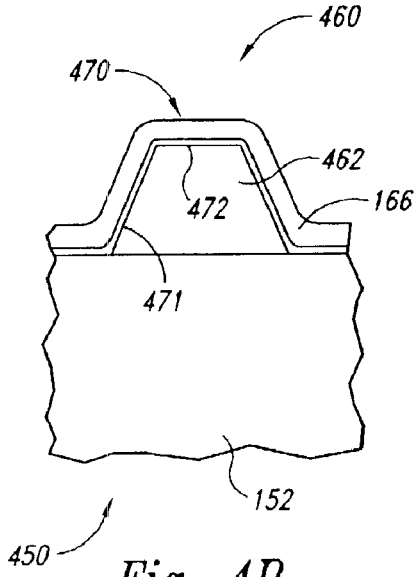
FIG. 4B is a cross-sectional view of a portion of an end effector having a contact element in accordance with another embodiment of the invention.

FIG. 4B is a cross-sectional view of a portion of an end effector 450 having a contact element 460 in accordance with another embodiment of the invention. The contact member 460 has a frusto-conical shape and includes a base 462 attached to the plate 152. The base 462 includes a first surface 471 and a second surface 472 that intersects the first surface 471 at the distal end of the base 462. The second surface 472 is a generally flat surface that extends generally parallel to the plate 152.

Figure 4C:
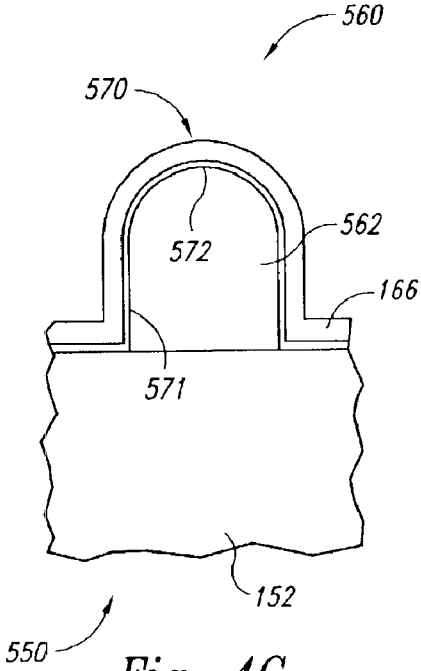
FIG. 4C is a cross-sectional view of a portion of an end effector having a contact element in accordance with another embodiment of the invention.

FIG. 4C is a cross-sectional view of a portion of an end effector 550 having a contact element 560 in accordance with another embodiment of the invention. The contact element 560 includes a base 562 having a first surface 571 forming a generally cylindrical portion and a second surface 572 forming a generally spherical top portion. Accordingly, the contact member 560 has a generally rounded tip 570.

Figure 4D:
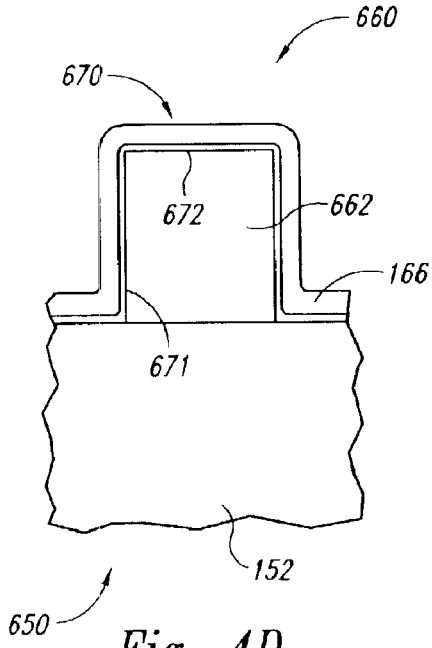
FIG. 4D is a cross-sectional view of a portion of an end effector having a contact element in accordance with another embodiment of the invention.

FIG. 4D is a cross-sectional view of a portion of an end effector 650 having a contact element 660 in accordance with another embodiment of the invention. The contact element 660 has a cylindrical shape and includes a base 662 defined by a first surface 671 and a second surface 672. Accordingly, the contact element 660 has a generally flat tip 670. In other embodiments, end effectors can have contact elements with other shapes.

Figure 5A:
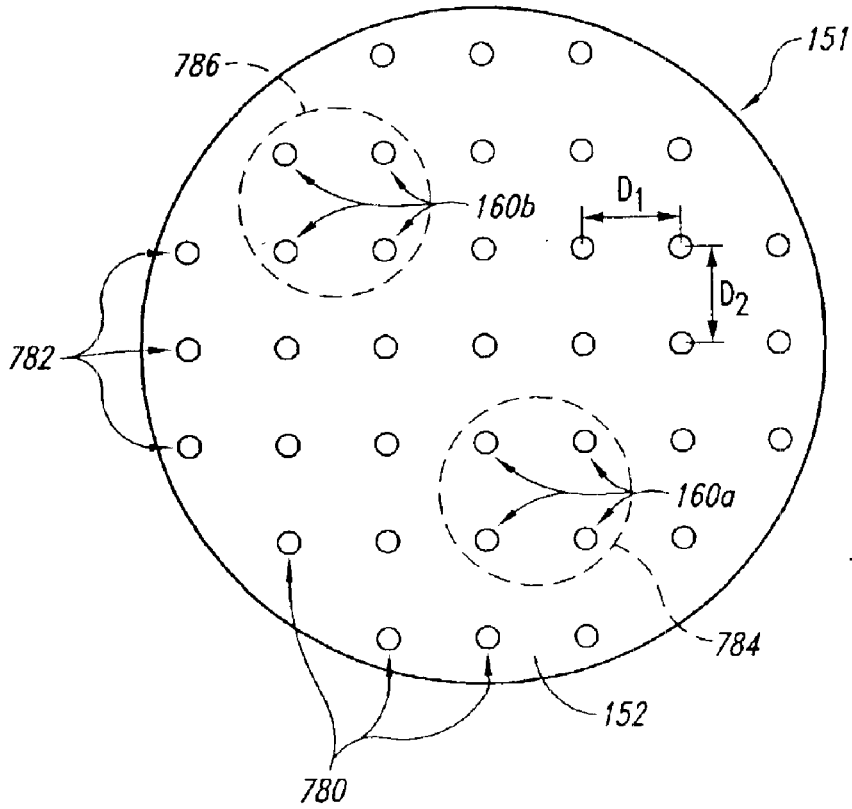
FIG. 5A is a bottom view of the end effector of FIG. 2A.

FIG. 5A is a bottom view of the end effector 151 of FIG. 2A. The end effector 151 includes a first plurality of contact elements 160*a* arranged in a first pattern in a first region 784 of the plate 152 and a second plurality of contact elements 160*b* arranged in a second pattern in a second region 786 of the plate 152. In the illustrated embodiment, the first pattern is similar to the second pattern. The contact elements 160 in each region 784, 786 are arranged in a grid with columns 780 and rows 782. Each contact element 160 within a row 782 is spaced apart from an adjacent contact element 160 by a first distance $D_1$. Each contact element 160 within a column 780 is spaced apart from an adjacent contact member 160 by a second distance $D_2$. In one embodiment, the first distance $D_1$ is approximately equal to the second distance $D_2$; in other embodiments, the first distance $D_1$ can be greater than or less than the second distance $D_2$.

Figure 5B:
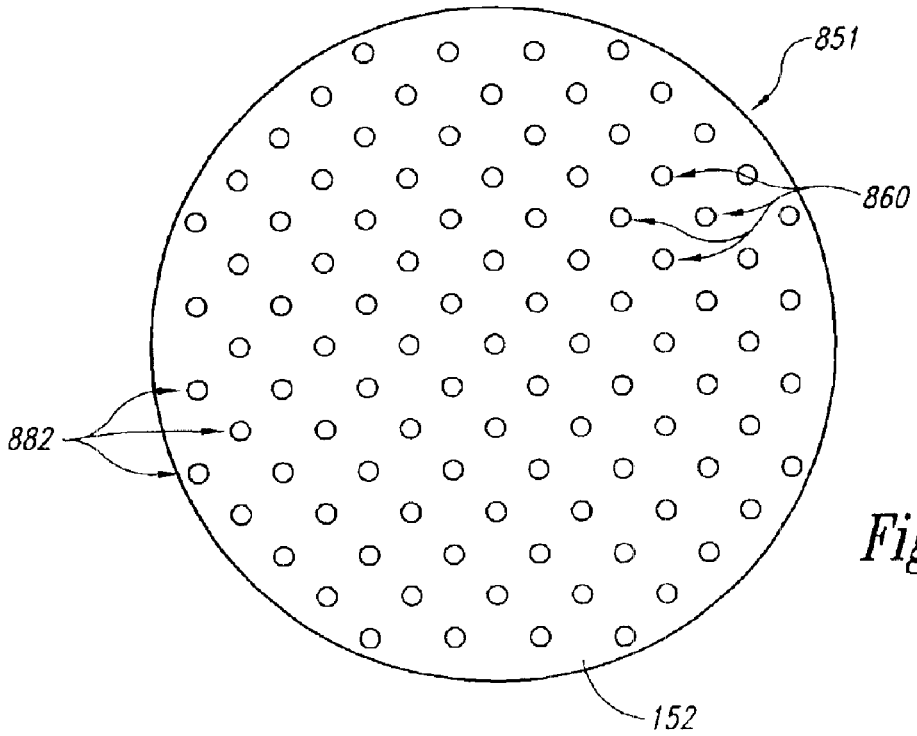
FIG. 5B is a bottom view of an end effector having a plurality of contact elements in accordance with another embodiment of the invention.

FIG. 5B is a bottom view of an end effector 851 having a plurality of contact elements 860 in accordance with another embodiment of the invention. The contact elements 860 can be similar to any of the contact elements described above with reference to FIGS. 2A–4D. The contact elements 860 are arranged in staggered rows with the elements 860 in one row 882 offset transversely from the neighboring elements 860 in adjacent rows 882. In other embodiments, the contact elements 860 can be arranged in other patterns or the elements 860 can be randomly distributed over the plate 152.

From the foregoing, it will be appreciated that specific embodiments of the invention have been described herein for purposes of illustration, but that various modifications may be made without deviating from the spirit and scope of the invention. For example, any of the contact elements described above with reference to FIGS. 4A–D can be used with the conditioner 150 described above with reference to FIG. 2A. Furthermore, any of these contact elements can be formed on an end effector with other contact elements having different heights, as described above with reference to FIG. 3. Accordingly, the invention is not limited except as by the appended claims.

I claim:

1. An end effector for conditioning a polishing pad used in polishing a micro-device workpiece, comprising:

a member having a first surface; and a plurality of generally uniformly shaped contact elements projecting generally transversely from the first surface, wherein the generally uniformly shaped contact elements comprises a plurality of first contact elements having a first height and a plurality of second contact elements having a second height greater than the first height, and wherein the first and second contact elements are distributed generally uniformly across at least a portion of the first surface.

2. The end effector of claim 1 wherein the uniformly shaped contact elements have a generally conical configuration.

3. The end effector of claim 1 wherein the uniformly shaped contact elements have a generally frusto-conical configuration.

4. The end effector of claim 1 wherein the uniformly shaped contact elements have a generally cylindrical configuration.

5. The end effector of claim 1 wherein the uniformly shaped contact elements comprise a generally rounded tip.

6. The end effector of claim 1 wherein at least one uniformly shaped contact element comprises a base and a wear-resistant layer over the base.

7. The end effector of claim 1 wherein at least one uniformly shaped contact element comprises a base and a carbon-like-diamond layer over the base.

8. The end effector of claim 1 wherein at least one uniformly shaped contact element comprises a base and a silicon layer over the base.

9. The end effector of claim 1 wherein at least one uniformly shaped contact element comprises a base and a silicon carbide layer over the base.

10. An end effector for conditioning a polishing pad used for polishing micro-device workpieces, comprising:

a plate having a first surface;

a first plurality of contact elements arranged in a first pattern in a first region of the first surface; and a second plurality of contact elements arranged in a second pattern in a second region of the first surface, wherein the first pattern is generally the same as the second pattern;

wherein the first plurality of contact elements have a first height and the second plurality of contact elements have a second height greater than the first height, and wherein the first region at least partially overlaps the second region.

11. The end effector of claim 10 wherein the first and second patterns comprise rows arranged in a grid.

12. The end effector of claim 10 wherein the first and second patterns comprise staggered rows.

13. The end effector of claim 10 wherein the contact elements in the first plurality of contact elements and the second plurality of contact elements have a generally uniform configuration.

14. The end effector of claim 10 wherein at least one contact element in the first plurality of contact elements and the second plurality of contact elements has a generally conical configuration.

15. The end effector of claim 10 wherein at least one contact element in the first plurality of contact elements and the second plurality of contact elements comprises a base and a carbon-like-diamond and/or silicon carbide layer over the base.

16. The end effector of claim 10 wherein at least one contact element in the first plurality of contact elements and the second plurality of contact elements comprises a silicon layer and a wear-resistant layer over the silicon layer.

17. The end effector of claim 10 wherein the contact elements in the first plurality of contact elements and the second plurality of contact elements comprise a base and are spaced apart from adjacent contact elements.

18. An end effector for conditioning a polishing pad used in polishing a micro-device workpiece, comprising:

a plate having a first surface; and a plurality of generally conical contact elements formed on or in the first surface, wherein the contact elements comprises a plurality of first contact elements having a first height and a plurality of second contact elements having a second height different from the first height, and wherein the first and second contact elements are distributed generally uniformly across at least a portion of the first surface.

19. The end effector of claim 18 wherein at least one contact element in the first and second contact elements comprises a base and a wear-resistant layer over the base.

20. The end effector of claim 18 wherein at least one contact element in the first and second contact elements comprises a conical base, and wherein the conical base comprises silicon.

21. The end effector of claim 18 wherein at least one contact element in the first and second contact elements comprises a conical base that is an integral part of the plate.

22. The end effector of claim 18 wherein the first and second contact elements are patterned in a grid.

23. The end effector of claim 18 wherein the first and second contact elements are arranged in staggered rows.

24. The end effector of claim 18 wherein the first and second contact elements are spaced apart from adjacent contact elements.

25. The end effector of claim 18 wherein at least one contact element in the first and second contact elements comprises a rounded tip.

26. An apparatus for conditioning a polishing pad used in polishing micro-device workpieces, comprising:

a table having a support surface;

a polishing pad coupled to the support surface of the table; and a conditioner including an end effector and a drive system coupled to the end effector, the end effector having a first surface and a plurality of generally uniformly shaped contact elements projecting generally transversely from the first surface, the generally uniformly shaped contact elements including a plurality of first contact elements having a first height and a plurality of second contact elements having a second height different than the first height, wherein the first and second contact elements are distributed generally uniformly across at least a portion of the first surface, and wherein the conditioner and/or the table is movable relative to the other to rub the plurality of contact elements against the polishing pad.

27. The apparatus of claim 26 wherein the first and second contact elements have a generally conical configuration.

28. The apparatus of claim 26 wherein at least one of the first and second contact elements comprises a base and a wear-resistant layer over the base.

29. The apparatus of claim 26 wherein the first and second contact elements are spaced apart from adjacent contact elements.

30. An apparatus for conditioning a polishing pad used in polishing micro-device workpieces, comprising:

a table having a support surface;

a polishing pad coupled to the support surface of the table; and a conditioner including an end effector and a drive system coupled to the end effector, the end effector having a first surface, a first plurality of contact elements arranged in a first pattern in a first region of the first surface, and a second plurality of contact elements arranged in a second pattern in a second region of the first surface, wherein the first pattern is generally the same as the second pattern and the first region at least partially overlaps the second region, wherein the first plurality of contact elements have a first height and the second plurality of contact elements have a second height different than the first height, and wherein the conditioner and/or the table is movable relative to the other to rub the first plurality of contact elements and the second plurality of contact elements against the polishing pad.

31. The apparatus of claim 30 wherein the first and second patterns comprise rows arranged in a grid.

32. The apparatus of claim 30 wherein the first and second patterns comprise staggered rows.

33. The apparatus of claim 30 wherein the contact elements in the first plurality of contact elements and the second plurality of contact elements have a generally uniform configuration.

34. An apparatus for conditioning a polishing pad used in polishing micro-device workpieces, comprising:

a table having a support surface;

a polishing pad coupled to the support surface of the table; and a conditioner including an end effector and a drive system coupled to the end effector, the end effector having a first surface and a plurality of generally conical contact elements formed on the first surface, the generally conical contact elements include a plurality of first contact elements having a first height and a plurality of second contact elements having a second height different than the first height, wherein the first and second contact elements are distributed generally uniformly across at least a portion of the first surface, and wherein the conditioner and/or the table is movable relative to the other to rub the plurality of contact elements against the polishing pad.

35. The apparatus of claim 34 wherein at least one contact element in the first and second contact elements comprises a conical base, and wherein the conical base comprises silicon.

36. The apparatus of claim 34 wherein the first and second contact elements are spaced apart from adjacent contact elements.

* * * * *